US006558563B2

(12) United States Patent
Kashiwaya et al.

(10) Patent No.: US 6,558,563 B2
(45) Date of Patent: May 6, 2003

(54) METHOD OF FABRICATING THERMAL HEAD

(75) Inventors: Makoto Kashiwaya, Kanagawa (JP); Junji Nakada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 53 days.

(21) Appl. No.: 09/822,872

(22) Filed: Apr. 2, 2001

(65) Prior Publication Data

US 2001/0054598 A1 Dec. 27, 2001

(30) Foreign Application Priority Data

Mar. 31, 2000 (JP) ..... 2000-097660

(51) Int. Cl.[7] ..... B44C 1/22
(52) U.S. Cl. ..... 216/41; 216/72; 347/203
(58) Field of Search ..... 216/41, 63, 67, 216/72, 80, 81; 347/200, 203

(56) References Cited

U.S. PATENT DOCUMENTS 6,002,418 A * 12/1999 Yoneda et al. ..... 347/203
6,243,941 B1 * 6/2001 Kashiwaya et al. ..... 324/73.1
6,316,054 B1 * 11/2001 Kashiwaya et al. ..... 427/249.1

FOREIGN PATENT DOCUMENTS

JP 62-227763 10/1987 ..... B41J/3/20
JP 7-132628 5/1995 ..... B41J/2/335

* cited by examiner

*Primary Examiner*—Kin-Chan Chen
(74) *Attorney, Agent, or Firm*—Sughrue Mion, PLLC

(57) ABSTRACT

A thermal head fabricating method forms a lower protective layer made of ceramics for protecting a plurality of heat-generating resistors and electrodes, subjects the lower protective layer to etching processing by a plasma and forms a carbon protective layer on the thus subjected lower protective layer. The etching processing is performed using a mask which defines an area where the carbon protective layer is formed, a protective layer is formed on a surface of the mask, and the protective layer is made of a material which is etched at an extremely slow rate or substantially not etched compared with ceramics composing the lower protective layer and/or which does not impart an adverse effect to the carbon protective layer that is subsequently formed.

3 Claims, 1 Drawing Sheet

METHOD OF FABRICATING THERMAL HEAD

The present invention relates to methods of fabricating thermal heads which are used in thermal recording apparatus such as various types of printers, plotters, facsimile machines, recorders and the like. Particularly, the present invention relates to a method of fabricating a thermal head which can enhance efficiency of etching processing to be performed on a lower protective layer using a mask in order to improve adhesion thereof to a carbon protective film, prior to forming the carbon protective layer having an excellent wear resistance.

Thermal recording materials comprising a thermal recording layer on a substrate of a film or the like are commonly used to record, for example, images produced in diagnosis by ultrasonic scanning.

This recording method, also referred to as thermal recording, eliminates the need for wet processing and offers several advantages including convenience in handling. Hence, in recent years, use of the thermal recording is not limited to small-scale applications such as images produced in diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising heat generating resistors (hereinafter referred to as heaters) and electrodes, used for heating the thermal recording layer of the thermal recording material to record an image are arranged in one direction (main scanning direction) and, with the glaze urged at a small pressure against the thermal recording layer of the thermal recording material (hereinafter referred to simply as thermal recording layer), the two members are moved relative to each other in an auxiliary scanning direction perpendicular to the main scanning direction, energy is applied to the heaters of the respective pixels in the glaze in accordance with image data to be recorded which were supplied from an image data supply source such as MRI or CT in order to heat the thermal recording layer thereby accomplishing image reproduction.

A protective film is formed on the surface of the glaze of the thermal head in order to protect the heaters for heating the thermal recording material, the associated electrodes and the like. Therefore, it is this protective film that contacts She thermal recording material during thermal recording and the heaters heat the thermal recording material through this protective film so as to perform thermal recording.

The above-described protective film is usually made of wear-resistant ceramics and the like; however, during thermal recording, the surface of the protective film is heated and kept in sliding contact with the thermal recording material, so it will gradually wear and deteriorate upon repeated recording.

If the resultant wear of the protective film progresses, density unevenness will occur on the thermal image or a desired protective strength can not be maintained and, hence, the ability of the film to protect the heaters and the like is impaired to such an extent that the intended image recording is no longer possible (the head has lost its function).

Particularly in the applications such as the aforementioned medical use which require multiple gradation images of high quality, a trend is toward ensuring a desired high image quality by adopting thermal films with highly rigid substrates such as polyester films and also increasing setting values of recording temperature (energy applied) and of pressure at which the thermal head is urged against the thermal recording material.

Under these circumstances, as compared with a conventional thermal recording system, a greater dynamic stress and more heat are exerted on the protective film of the thermal head, permitting wear and corrosion (or wear due to corrosion) more likely to progress. Further, in a thermal film using a polyester film and the like as the substrate thereof, a substance which causes the corrosion of the protective film such as water contained in the thermal recording layer does not penetrate into the substrates and sticks on the surface of the thermal head, namely, the protective layer thereof so that a concentration of a corrosive substance on the surface of the protective layer is likely to be increased thereby causing a further progress of corrosion.

With a view to preventing the wear of the protective film on such a thermal head and improving its durability, a number of techniques to perform improvement of the protective film, improvement of the thermal recording material, improvement of a recording condition or the like have been proposed or practically executed.

Among the above-described improvements, the improvement of the thermal recording material primarily intends to reduce a quantity of a component which will cause wear or corrosion; however, in this case, an adverse effect such as dust deposition on the head, sticking of the head or the like may occurs at the same time whereupon a sufficient wear resistant effect may not be obtained.

On the other hand, the improvement of the recording condition intends to reduce a maximum temperature or recording pressure of thermal recording, but this method sometimes has an effect on an image quality of the recording image, in particular, in an application in which a high-quality image is required, a sufficient effect can not be obtained in some cases.

Therefore, in order to prevent wear of the protective film on the thermal head, a multiplicity of techniques to enhance performance of the protective film has been studied.

As a method to enhance the wear resistance of the protective film as described above, Unexamined Published Japanese Patent Application No. 62-227763 discloses use of a diamond thin film as a protective film.

Further, it has been proposed that a thermal head having an excellent durability can be realized by enhancing the wear resistance of the protective film by means of provision of a plurality of layers of the protective films.

For example, Unexamined Published Japanese Patent Application (Kokai) No. 7-132628 discloses a thermal head which has a dual protective film comprising a lower silicon-based compound layer and an overlying diamond-like carbon layer (DLC layer, hereinafter also referred to simply as "carbon layer") whereby the potential wear and breakage of the protective film are significantly reduced to ensure that high-quality images can be recorded over an extended period of time.

When a thermal head having such a dual-layer structure is produced, in order to enhance adhesion between the lower silicon-based compound layer (for example, silicon nitride layer, hereinafter referred to as "silicon nitride layer") and the overlying carbon layer, the overlying carbon layer is formed after a surface of the lower silicon nitride layer is subjected to etching processing by plasma and the like. Namely, smear on the surface of the lower silicon nitride layer is removed by etching processing to have the surface cleaned.

On this occasion, the carbon layer is formed in a limited area such as a portion just above the heater and the like so that, when the surface of the silicon nitride layer is cleaned by the above-described etching processing, the etching processing is performed after other areas than the portion where the above-described carbon layer is formed is shielded with a mask. As an example of the mask, a structure composed of a stainless steel (SUS) material and the like is ordinarily repeatedly used.

After the etching processing is performed, the carbon layer is formed by a method such as sputtering or the like. On this occasion, when the mask composed of the above-described stainless steel material is used, there occurred a problem that the processing was not always stabilized. Namely, in some cases, the carbon layer having good adhesion was able to be formed; in other cases, the formed carbon layer had insufficient adhesion thereby peeling off while in use.

SUMMARY OF THE INVENTION

The present invention has been accomplished under these circumstances and has as an object providing a method of fabricating a thermal head which has solved problems of the conventional techniques and is capable of stabilizing a process for forming a carbon layer in order to enhance the adhesion between a lower silicon-based compound layer and the upper carbon layer.

The stated object of the present invention can be attained by a method of fabricating a thermal head, comprising the steps of: forming a lower protective layer comprising ceramics for protecting a plurality of heat-generating resistors and electrodes; subjecting the lower protective layer to etching processing by a plasma; and forming a carbon protective layer on the thus subjected lower protective layer, wherein the etching processing is performed using a mask which defines an area where the carbon protective layer is formed, a protective layer is formed on a surface of the mask, and the protective layer is made of a material which is etched at an extremely slow rate or substantially not etched compared with ceramics composing the lower protective layer and/or which does not impart an adverse effect to the carbon protective layer that is subsequently formed.

Preferably, the protective layer is made of carbon, and the carbon is the material which is etched in the extremely slow rate or substantially not etched compared with the ceramics composing the protective layer and/or which does not impart the adverse effect to the carbon protective layer that is subsequently formed.

Preferably, the mask is made of stainless steel.

In the method of fabricating the thermal head according to the present invention, based on an analysis of causes which unstabilized the process by the above-described conventional techniques, a surface of the stainless steel material used as a mask is covered with a material which is etched in an extremely slow rate or substantially not etched compared with the stainless steel material or another material which does not have an adverse effect on the carbon protective layer that is subsequently formed thereon. By this arrangement, an occurrence of a phenomenon that the stainless steel material which constitutes the mask is etched and a portion of the thus etched-away material is deposited as a foreign matter on the ceramic-based lower protective layer is prevented thereby enhancing adhesion between the carbon protective layer that is subsequently formed and the ceramic-based lower protective layer. As a result, the carbon protective layer can be prevented from peeling off the ceramic-based lower protective layer.

Namely, the above-described causes which unstabilized the process was attributable to that, since there was not much difference between a rate at which the stainless steel material used as a mask was etched by plasma and another rate at which the ceramic-based lower protective layer that was the principal target for etching was etched, the stainless steel material was etched whereby a portion of the resultant etched-off material was deposited on the ceramic-based lower protective layer as a foreign matter.

Therefore, the surface of the stainless steel material composing the mask is covered by a material which is hard to be etched compared with this stainless steel material (that is, etching speed thereof is extremely low compared with that of the ceramic-based lower protective layer which is a principal target for the above-described etching) and does not have an adverse effect on the carbon protective layer that is subsequently formed thereon. Carbon is effective as a covering material but the present invention is not limited thereto.

According to the present invention, by allowing a thermal head to have arrangements as described above, a method which is capable of fabricating the thermal head having a carbon protective layer on a ceramic-based protective layer in a consistent manner can be achieved.

DETAILED DESCRIPTION OF THE INVENTION

Embodiments of the present invention will now be described in detail with reference to the preferred embodiments shown in the accompanying drawings.

Figure 1:
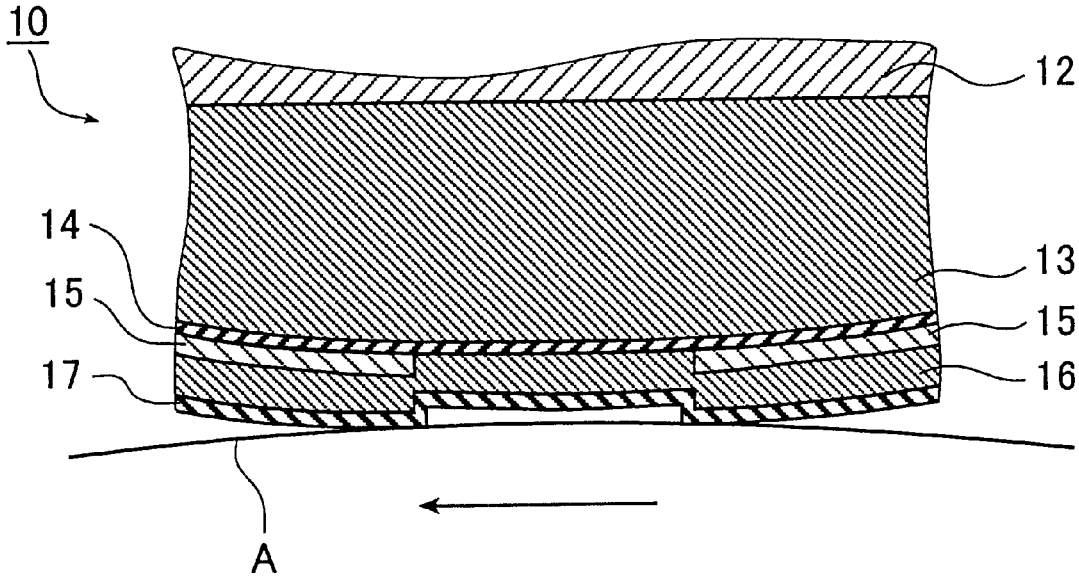
FIG. 1 is a schematic cross-sectional view of a thermal head to be fabricated by a fabrication method according to an embodiment of the present invention.

FIG. 1 is a schematic cross-sectional view of a thermal head 10 to be fabricated by a fabrication method according to an embodiment of the present invention.

To fabricate the thermal head 10, a top of a substrate 12 (thermal head 10 illustrated in FIG. 1 is shown faced own since the thermal head 10 is pressed downward against a thermal recording material A) is overlaid with a glaze layer 13 which, in turn, is overlaid with a heater 14 which, in turn, is overlaid with an electrode 15 which, in turn, is overlaid with a protective film which protects the heater 14 and optionally the electrode 15 and other parts. The illustrated protective film is composed of at least two layers: a silicon nitride-based lower protective layer 16 and a carbon-based upper protective layer (carbon film) 17 which is formed on the lower protective layer 16.

The thermal head 10 to be used in the present invention has essentially the same structure as known versions of thermal head except for a method of forming the protective film. Therefore, arrangements of layers (films) and constituent materials of the glaze layer 13 are not limited in any particular way and various known versions may be employed. Specifically, the substrate 12 may be formed of various electrical insulating materials including heat-resistant glass and ceramics such as alumina, silica and magnesia; the glaze layer 13 may be formed of heat-resistant glass and the like; the heater 14 may be formed of heat-generating resistors such as Nichrome (Ni—Cr), tantalum metal and tantalum nitride; and the electrodes 15 may be formed of electrically conductive materials such as copper and the like.

It is known that heaters are available usually in two types; one is a thin-film-type heating element which is formed by a "thin-film" process such as vacuum evaporation, chemical vapor deposition (CVD), sputtering and the like and a photoetching technique; the other is a thick-film-type heating element which is formed by a "thick-film" process comprising the steps of printing (e.g., screen printing) and firing and an etching technique. The thermal head 10 adapted for the method of fabrication according to the present invention may be formed by either method.

As a material of the lower protective layer 16 to be formed on the above-described thermal head 10, a known ceramic-based material can be used, though not particularly limited thereto, as long as it has sufficient heat resistance and corrosion resistance to serve as the protective film of the thermal head.

Specifically, illustrated are silicon nitride shown in the above-described embodiment, silicon carbide, silicon nitride, tantalum oxide, aluminum oxide, SIALON, LASION, silicon oxide, aluminum nitride, boron nitride, seleniumoxide, titanium nitride, titanium carbide, titanium carbide nitride, chromium nitride and mixtures thereof. Among others, silicon nitride, silicon carbide, SIALON and the like are preferably used from various aspects such as easy film deposition, reasonability in manufacturing including manufacturing cost, balance between mechanical wear and chemical wear. Additives such as metals and the like may be incorporated in the above materials in small amounts to adjust physical properties thereof.

Methods of forming the lower protective layer 16 are not limited in any particular way and known methods of forming ceramic films (layers) may be employed by applying the aforementioned thick-film and thin-film processes and the like, on this occasion, optionally, the lower protective layer 16 may comprise a plurality of layers which are formed of different materials or a same material.

Further, a thickness of the lower protective layer 16 is not limited to any particular value but it ranges preferably from about 2 $\mu$m to about 20 $\mu$m, more preferably from about 4 $\mu$m to about 10 $\mu$m. If the thickness of the lower protective layer 16 is set within the stated ranges, favorable results can be obtained in various aspects; for example, the balance between wear resistance and heat conductivity (namely, recording sensitivity) can advantageously be obtained.

Methods of forming the carbon upper protective layer 17 are not limited in any particular way and known thick- and thin-film processes may be employed. Preferred examples include a method of forming a hard carbon film (sputter-forming carbon film) by the sputtering of a carbonaceous material (e.g., sintered carbon or glassy carbon) as a target and a method of forming a hard carbon film (diamond-like carbon film, DLC film) by the plasma-assisted CVD using a hydrocarbon gas as a reactive gas.

When the thermal head 10 which the fabrication method according to the present embodiment is applied to is fabricated, in order to enhance the adhesion between the sputter-forming carbon film (upper protective layer) 17, and the lower protective layer 16, as described above, the surface of the lower protective layer 16 is etched before the sputter-forming carbon film (upper protective layer) 17 is formed by plasma. An intensity of etching may be determined with reference to a bias voltage to be applied to the substrate; usually, an optimal value may be selected from a range of −100 V to −500 V.

Examples of the plasma generating gas for producing the above-described DLC film are inert gases such as helium, neon, argon, krypton, xenon and the like, among which argon gas is used with particular advantage because of its price and easy availability. On the other hand, examples of the reactive gases for producing the DLC film are gases of hydrocarbon compounds such as methane, ethane, propane, ethylene, acetylene, benzene and the like.

In the deposition of the DLC film (upper protective layer) 17 by the plasma-assisted CVD, the plasma generating device may utilize various discharges such as DC discharge, RF discharge, DC arc discharge and microwave ECR discharge, among which DC arc discharge and microwave ECR discharge have high enough plasma densities to be particularly advantageous for high-speed film deposition.

In DC discharge, a plasma is generated by applying a negative DC voltage between the substrate and the electrode. The DC power supply for use in DC discharge may be selected from those which produce outputs having powers in a range of about 1 to 10 kW which are necessary and sufficient to perform the DLC film deposition. For anti-arc and other purposes, a DC power supply pulse-modulated for 2 to 20 kHz is also applicable with advantage.

In RF discharge, a plasma is generated by applying a radio-frequency voltage to the electrodes via a matching box, which performs impedance matching such that the reflected wave of the radio-frequency voltage is no more than 25% of the incident wave. A suitable RF power supply for RF discharge may be selected from those in commercial use which produce outputs at 13.56 MHz having powers in a range of about 1 kW to about 10 kW which are necessary and sufficient to perform the DLC film. deposition. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10 A to about 50 A having powers in a range of about 1 kW to about 10 kW which are necessary and sufficient to perform the DLC film deposition.

When the DLC film is used as the upper protective layer 17, it is also preferable that the surface of the lower protective layer 16 is etched by the plasma before the DLC film deposition is performed in order to enhance the adhesion between the DLC film (upper protective layer) 17 and the lower protective layer 16.

A method of etching is similar to that of sputtering such that the RF voltage is applied to the substrate via the matching box. A suitable RF power supply may be selected from those in commercial use which produce outputs at 13.56 MHz having powers in a range of about 1 kW to about 5 kW. Further, the intensity of etching may be determined with reference to the bias voltage to be applied to the substrate; usually, an optimal value may be selected from a range of −100 V to −500 V.

A thickness of the upper protective layer 17 to be formed by the above-described method is not limited to any particular value but it preferably ranges from about 0.1 $\mu$m to about 5 $\mu$m and more preferably from about 1 $\mu$m to about 3 $\mu$m. If the thickness of the upper protective layer 17 is set within the stated ranges, favorable results can be obtained in various aspects; for example, the balance between wear resistance and heat conductivity can advantageously be obtained. On this occasion, optionally, the upper protective layer 17 may comprise a plurality of layers which are formed of different materials or the same material.

Hardness of the upper protective layer 17 is not limited to any particular value as far as the upper protective layer 17 has a sufficient hardness to serve as the protective film of the thermal head. For example, the upper protective layer 17 having a Vickers hardness of from 3000 kg/mm$^2$ to 5000 kg/mm$^2$ is advantageously illustrated. The hardness may be constant or varied in a thickness direction of the upper protective layer 17. In a latter case, harness variations may be continuous or stepwise.

On the foregoing pages, the thermal head of the present invention has been described in detail but the present invention is in no way limited to the stated embodiments and various improvements and modifications can of course be made without departing from the spirit and scope of the invention.

The present invention will be further illustrated by means of the following specific examples.

EXAMPLE

A sputter-forming carbon film was formed on a surface of a glaze of a thermal head as an upper protective layer by using a sputtering method as described above in a way as described below to fabricate the thermal head. The thermal head used as a base has a silicon nitride ($Si_3N_4$) film formed in a thickness of 11 $\mu$m as a protective film on the surface of the glaze. Therefore, in the present Example, the silicon nitride film serves as a lower protective layer on which the sputter-forming carbon film is formed as an upper protective layer.

Figure 2:
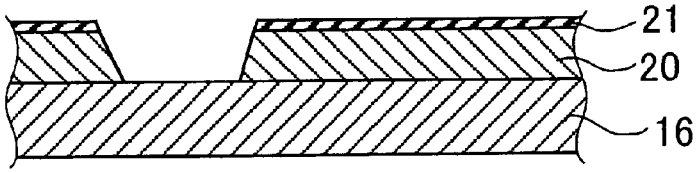
FIG. 2 is a schematic view of a state at a time of etching a silicon nitride layer according to an embodiment.

FIG. 2 schematically shows an etching state of the silicon nitride film (lower protective layer) 16.

A mask 20 composed of a stainless steel material was placed on the silicon nitride film 16 of the thermal head as the base and the resultant composition was etched by Ar-RF plasma for 60 minutes under a condition that Vdc was set at −500 V. However, it is characteristic that a hard carbon protective layer 21 has preliminarily been formed on an upper surface of the mask 20 used on this occasion. A thickness of the carbon protective layer 21 is between about 2 $\mu$m and about 20 $\mu$m, preferably between about 4 $\mu$m and about 10 $\mu$m.

When an etching operation is performed using the mask 20 on which the carbon protective layer 21 has been formed in a manner as described above, since a speed for etching the carbon protective layer 21 is extremely low compared with that for etching the silicon nitride film (lower protective layer) 16, it becomes possible to substantially etch only the silicon nitride efficiently. On this occasion, the stainless steel material which constructs the mask 20 is scarcely etched.

After the etching operation has been performed in this manner, the carbon protective film (upper protective layer) 17 was formed by a sputtering operation on the silicon nitride film (lower protective layer) 16 which has been etched in a manner as described above. When an interface between the silicon nitride film (lower protective layer) 16 and the carbon protective film 17 formed thereon was analyzed by a secondary ion mass spectrometry (SIMS), the stainless steel material which constructs the mask 20 was not detected.

Evaluation of Performance

Using the thus fabricated thermal head, a recording test was conducted on the above-described thermal recording material A; test results showed that, after 50,000 sheets of thermal recording paper A were subjected to continuous recording, a problem, such as peel-off or the like of the carbon film (upper protective layer) 17 which formed a protective film of the thermal head was not detected. Namely, a desired object was accomplished.

Comparative Example

In a way similar to that in Example, a mask 20 constructed by a stainless steel material was placed on a silicon nitride film (lower protective layer) 16 of a thermal head as a base and the resultant composition was etched by Ar-RF plasma for 60 minutes under a condition that Vdc was set at −500 V. In this case, the procedure of Example was repeated to fabricate the thermal head except that the carbon protective layer 21 as illustrated in Example has nor been formed on an upper surface of the mask 20.

Evaluation of Performance

Performance was evaluated as in Example, using the above-described thermal head and thermal recording material A.

Firstly, in SIMS analysis, a large quantity of the mask component was detected in an interface between the silicon nitride film (lower protective layer) 16 and a carbon protective film (upper protective layer) 17. Further, recording tests show that, after continuous recording of 1000 sheets, the carbon protective film 17 peeled off.

These results clearly demonstrate the effectiveness of the thermal head of the present invention.

It goes without saying that the above-described Example is given to illustrate the present invention and the present invention is by no means limited to the Example.

To take an example, in the above-described Example, it has been explained that the carbon protective film 17 was formed directly on the silicon nitride film (lower protective layer) 16; however, optionally an intermediate layer may appropriately be provided between these protective films.

Further, illustrated component materials of respective layers composing the thermal head can be used in any combination thereof.

As described above in detail, the present invention is capable of consistently performing a step of forming a carbon protective film in order to enhance adhesion between a silicon-based compound film as a lower layer and a carbon protective film as an upper layer thereby providing a great effect in improvement of a fabrication method of a thermal head.

What is claimed is:

1. A method of fabricating a thermal head, comprising the steps of:

forming a lower protective layer comprising ceramics for protecting a plurality of heat-generating resistors and electrodes;

subjecting said lower protective layer to etching processing by a plasma; and forming a carbon protective layer on the thus subjected lower protective layer, wherein said etching processing is performed using a mask which defines an area where said carbon protective layer is formed, a protective layer is formed on a surface of said mask, and said protective layer is made of a material which is etched at a slower rate than ceramics or substantially not etched as compared with ceramics which comprise said lower protective layer and/or which does not impart an adverse effect to said carbon protective layer that is subsequently formed.

2. The method of fabricating the thermal head according to claim 1, wherein said protective layer is made of carbon.

3. The method of fabricating the thermal head according to claim 1, wherein said mask is made of stainless steel.

* * * * *